US008991300B2

(12) United States Patent
Moroi et al.

(10) Patent No.: US 8,991,300 B2
(45) Date of Patent: Mar. 31, 2015

(54) VARIABLE DISPLACEMENT SWASH PLATE TYPE COMPRESSOR

(71) Applicants: Kabushiki Kaisha Toyota Jidoshokki, Kariya-shi, Aichi-ken (JP); Kabushiki Kaisha Toyota Chuo Kenkyusho, Nagakute-shi, Aichi-ken (JP)

(72) Inventors: Takahiro Moroi, Kariya (JP); Masakazu Obayashi, Kariya (JP); Naofumi Kimura, Kariya (JP); Yoshio Kimoto, Kariya (JP); Noritaka Nishimori, Kariya (JP); Yasuhiro Kondoh, Nisshin (JP); Etsuko Hori, Nagoya (JP)

(73) Assignees: Kabushiki Kaisha Toyota Jidoshokki, Aichi-ken (JP); Kabushiki Kaisha Toyota Chuo Kenkyusho, Aichi-ken (JP)

( * ) Notice: Subject to any disclaimer, the term of this patent is extended or adjusted under 35 U.S.C. 154(b) by 265 days.

(21) Appl. No.: 13/752,994

(22) Filed: Jan. 29, 2013

(65) Prior Publication Data

US 2013/0195686 A1 Aug. 1, 2013

(30) Foreign Application Priority Data

Feb. 1, 2012 (JP) ..... 2012-020160

(51) Int. Cl.
*F04B 53/14* (2006.01)
*F04B 1/29* (2006.01)
*F04B 27/08* (2006.01)

(52) U.S. Cl.
CPC ..... *F04B 1/29* (2013.01); *F04B 27/0878* (2013.01)
USPC ..... 92/172; 92/71; 417/269; 417/222.1

(58) Field of Classification Search
USPC ..... 417/417, 222.1, 415, 399, 401; 91/499; 92/71, 172, 12.2; 123/193.1, 193.2, 123/193.3, 193.4, 193.5, 193.6
See application file for complete search history.

(56) References Cited

U.S. PATENT DOCUMENTS 3,035,879 A * 5/1962 Hanny et al. ..... 92/112
3,181,779 A * 5/1965 Rhodes ..... 417/566

(Continued)

FOREIGN PATENT DOCUMENTS

DE 600 37 087 T2 3/2001
JP 57-95484 U 6/1982

(Continued)

OTHER PUBLICATIONS

German Office Action for corresponding DE Patent Application No. 10 2013 100 869.09 issued on Sep. 4, 2013.

*Primary Examiner* — Devon Kramer
*Assistant Examiner* — Nathan Zollinger
(74) *Attorney, Agent, or Firm* — Sughrue Mion, PLLC

(57) ABSTRACT

The present invention provides a variable displacement swash plate type compressor that reduces wear of cylinder bores and the amount of blow-by gas. Each piston of the compressor has a piston main body, which has a distal portion located at an end corresponding to the compression chamber. A tapering portion and an arcuate portion are formed in the distal portion. The arcuate portion is continuous with an end of the tapering portion that is closer to the compression chamber. The tapering portion and the arcuate portion each have a diameter that increases toward the skirt. The tapering portion has a tapering angle that is in a range from 0.45 degrees to 1.5 degrees. The distance between the distal end of the piston main body and a starting point of the tapering portion on an end closer to the skirt is set in a range from 1.5 mm to 5.0 mm.

8 Claims, 4 Drawing Sheets

(56) References Cited

U.S. PATENT DOCUMENTS

| | | | | |
|---|---|---|---|---|
| 4,106,463 | A * | 8/1978 | Curtis et al. | 123/193.6 |
| 4,246,833 | A * | 1/1981 | Burklund | 92/155 |
| 5,960,542 | A * | 10/1999 | Umemura et al. | 29/888.042 |
| 5,970,845 | A * | 10/1999 | Beck | 92/172 |
| 6,415,705 | B1 * | 7/2002 | Kato et al. | 92/71 |
| 6,506,032 | B2 * | 1/2003 | Kawahara et al. | 417/417 |
| 6,575,080 | B1 * | 6/2003 | Enokijima et al. | 92/71 |
| 2005/0025648 | A1 | 2/2005 | Shimizu et al. | |
| 2006/0257274 | A1 * | 11/2006 | Umeoka et al. | 417/415 |
| 2008/0118375 | A1 * | 5/2008 | Muth et al. | 417/363 |

FOREIGN PATENT DOCUMENTS

| | | | |
|---|---|---|---|
| JP | 5-12673 | U | 2/1993 |
| JP | 09-177670 | A | 7/1997 |
| JP | 2003-206856 | A | 7/2003 |
| JP | 2004-239077 | A | 8/2004 |
| JP | 2005-069215 | A | 3/2005 |
| JP | 2008-106608 | A | 5/2008 |

* cited by examiner

VARIABLE DISPLACEMENT SWASH PLATE TYPE COMPRESSOR

BACKGROUND OF THE INVENTION

The present invention relates to a variable displacement swash plate type compressor capable of controlling displacement by controlling the inclination angle of the swash plate based on the pressure in a crank chamber.

A variable displacement swash plate type compressor includes a swash plate, which is accommodated in a crank chamber. The inclination angle of the swash plate is variable. High-pressure control gas is supplied to the crank chamber, and the pressure in the crank chamber is controlled by controlling the amount of the supplied control gas. Accordingly, the compressor displacement is controlled. Specifically, when the crank chamber pressure is raised, the inclination angle of swash plate is reduced, which reduces the stroke of the pistons in the cylinder bores. Accordingly, the displacement is reduced. In contrast, when the crank chamber pressure is lowered, the inclination angle of the swash plate is increased, which increases the stroke of the pistons in the cylinder bores. Accordingly, the displacement is increased.

However, high-pressure refrigerant gas, which has been compressed in compression chambers, may be introduced as blow-by gas into the crank chamber through between each piston and the corresponding cylinder bore (through side clearances). When such blow-by gas enters the crank chamber, the crank chamber pressure cannot be set to a control target value, and the inclination angle of the swash plate deviates from a desired angle. Desired displacement thus cannot be achieved.

In a case in which a variable displacement swash plate type compressor is installed in a refrigerant circuit (external refrigerant circuit) of a vehicle air conditioner, it is preferable that the amount of lubricant circulated in the refrigerant circuit be limited to improve the cooling efficiency. However, if the amount of lubricant circulated in the refrigerant circuit is reduced, lubrication between the pistons and the cylinder bores deteriorates, which will increase wear of the cylinder bores. As a result, the amount of blow-by gas entering the crank chamber is increased.

For example, Japanese Laid-Open Patent Publication No. 2003-206856 discloses a technology for reducing wear of cylinder bores. As shown in FIG. 6, a piston 90 disclosed in the document has a tapered surface 92 at the distal end of the outer circumferential surface of a columnar portion 91. The piston 90 also has a chamfered portion 93, which is continuous with the tapered surface 92. The diameter of the outer circumferential surface of the columnar portion 91 decreases toward the distal end. When coating is applied to the outer circumferential surface of the piston 90, the above described configuration prevents the coating material from remaining at the distal portion of the columnar portion 91, so that no annular protrusion is formed at the distal portion. As a result, the cylinder bore is prevented from being scratched by such an annular protrusion. Wear of the cylinder bore is thus reduced. Further, the structure of the tapered surface 92, the chamfered portion 93, and the decreasing diameter toward the distal end of the piston 90 allows lubricant to enter between the piston 90 and the cylinder bore.

However, according to the document, the shape of the piston 90 changes from the distal end toward the proximal end, particularly sharply at a section from the chamfered portion 93 to the tapered surface 92. As a result, the side clearance, which is formed between the piston 90 and the cylinder bore, sharply narrows. This makes it difficult for lubricant to enter between the piston 90 and the cylinder bore. Accordingly, the lubrication between the piston 90 and the cylinder bore deteriorates, and wear of the cylinder bore increases. As a result, the entering amount of blow-by gas will be increased.

SUMMARY OF THE INVENTION

The present invention relates to a variable displacement swash plate type compressor that reduces wear of a cylinder bore and the amount of blow-by gas.

To achieve the foregoing objective and in accordance with one aspect of the present invention, a variable displacement swash plate type compressor is provided that includes a cylinder block, in which a plurality of cylinder bores are formed, a plurality of single-headed pistons, a drive shaft, a swash plate, a crank chamber, and a plurality of compression chambers. Each piston is accommodated in one of the cylinder bores and has a main body and a skirt. The skirt is formed at a position closer to a proximal end of the piston than the main body. The swash plate rotates integrally with the drive shaft and is engaged with the skirts. The crank chamber accommodates the swash plate. Each compression chamber is defined in one of the cylinder bores by the associated piston main body. The displacement of the compressor is controllable by controlling the inclination angle of the swash plate by changing the pressure in the crank chamber. Each piston main body has a distal portion located on an end corresponding to the compression chamber. A tapering portion and an arcuate portion are formed in the distal portion. The arcuate portion is continuous with an end of the tapering portion that is closer to the compression chamber. The tapering portion and the arcuate portion each have a diameter that increases toward the skirt. The tapering portion has a tapering angle that is in a range from 0.45 degrees to 1.5 degrees. The distance between the distal end of the piston main body and a starting point of the tapering portion on an end closer to the skirt is set in a range from 1.5 mm to 5.0 mm.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of the present invention will now be described with reference to FIGS. 1 to 5.

Figure 1:
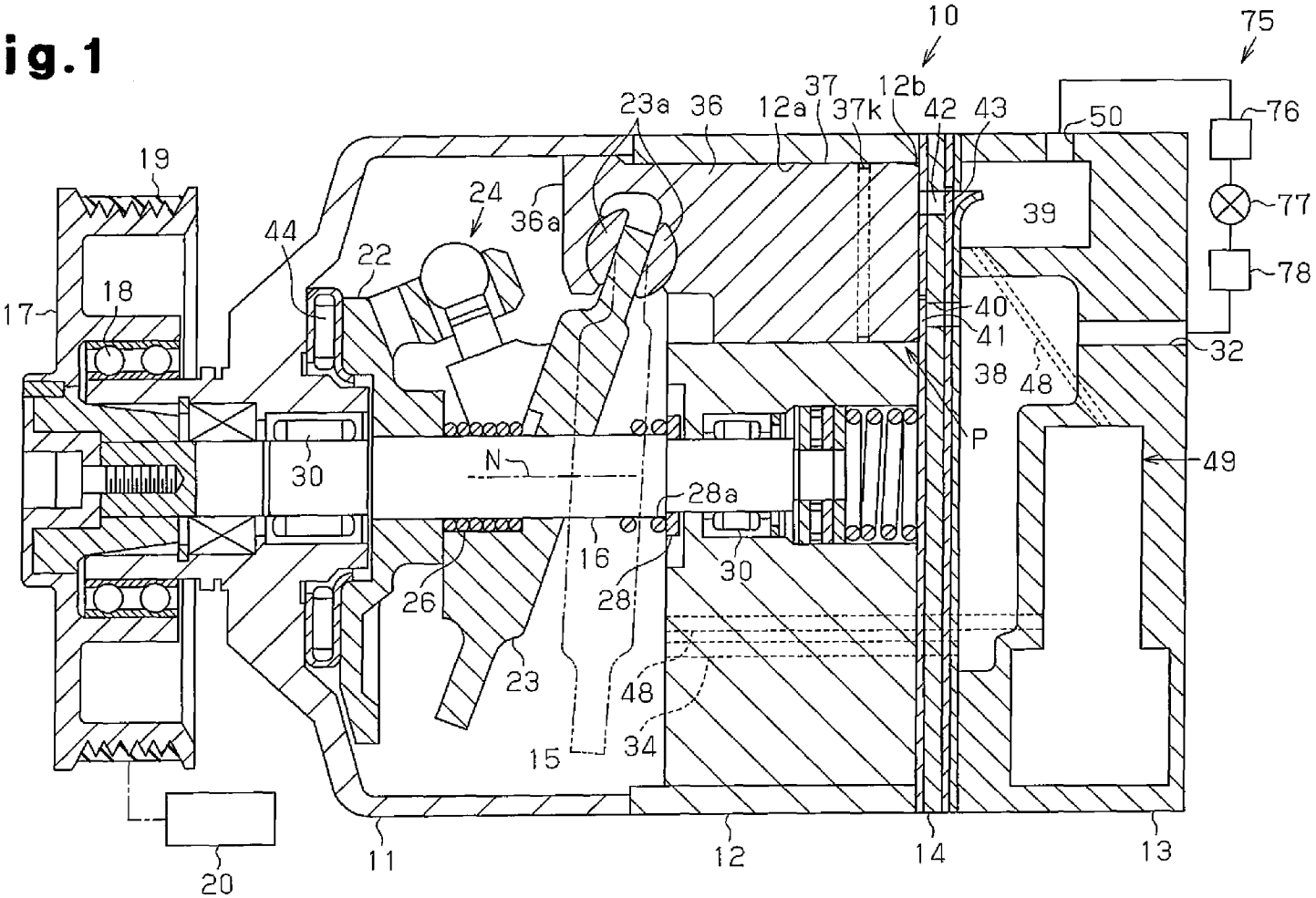
FIG. 1 is a cross-sectional view illustrating a variable displacement swash plate type compressor according to one embodiment of the present invention.

As shown in FIG. 1, the housing of a variable displacement swash plate type compressor 10 (hereinafter, referred to as a compressor 10), which is mounted on a vehicle, includes a cylinder block 12. A front housing member 11 is joined to an end of the cylinder block 12, and a rear housing member 13 is joined to the other end with an intercalated member 14 in between. The front housing member 11 and the cylinder block 12 define a crank chamber 15. The front housing member 11 and the cylinder block 12 rotationally support a drive shaft 16 via a radial bearing 30. The drive shaft 16 extends through the crank chamber 15.

A pulley 17 is rotationally supported by a distal outer wall of the front housing member 11 via an angular bearing 18. The pulley 17 is coupled to the distal end of the drive shaft 16. The pulley 17 is directly connected to a vehicle engine 20, which serves as an external drive source, via a belt 19. That is, no clutch mechanism such as en electromagnetic clutch is provided between the pulley 17 and the vehicle engine 20. Thus, during operation of the vehicle engine 20, the drive shaft 16 is rotated by drive force transmitted by the belt 19 and the pulley 17, which function as a power transmission mechanism. In this manner, the drive shaft 16 receives rotational drive force from the vehicle engine 20 via the clutchless power transmission mechanism.

In the crank chamber 15, the rotary support 22 is fixed to the drive shaft 16 to rotate integrally with the drive shaft 16, and the rotary support 22 is supported by the front housing member 11 via a thrust bearing 44. The drive shaft 16 supports a swash plate 23, which is permitted to slide along the central axis N and be inclined relative to the drive shaft 16. The rotary support 22 and the swash plate 23 are coupled to each other by a hinge mechanism 24. The hinge mechanism 24 allows the swash plate 23 to rotate integrally with the drive shaft 16 about the central axis N of the drive shaft 16.

A spring 26 is located between the rotary support 22 and the swash plate 23 to surround the drive shaft 16. The spring 26 urges the swash plate 23 to tilt the swash plate 23 toward the cylinder block 12. A stopper ring 28 is attached to the drive shaft 16 at a position between the swash plate 23 and the cylinder block 12, and a spring 28*a* is fitted about the drive shaft 16 between the stopper ring 28 and the swash plate 23. When compressed, the spring 28*a* urges the swash plate 23 to tilt toward the rotary support 22.

When the swash plate 23 is inclined toward the rotary support 22 to a position where the swash plate 23 contacts the rotary support 22, a further inclination of the swash plate 23 is restricted. In this restricted state, the inclination angle of the swash plate 23 is the maximum value. On the other hand, when the swash plate 23 is inclined toward the cylinder block 12 to contact and compress the spring 28*a*, a further inclination of the swash plate 23 is restricted. In this restricted state, the inclination angle of the swash plate 23 is the minimum value, which is slightly greater than 0 degrees.

The cylinder block 12 has cylinder bores 12*a*, which are arranged about the drive shaft 16. Each cylinder bore 12*a* accommodates a single-headed piston 36. The piston 36 is permitted to reciprocate and has a diameter of 28 to 40 mm. Each piston 36 is coupled to a peripheral portion of the swash plate 23 by a pair of shoes 23*a* and is reciprocated within the associated cylinder bore 12*a* through rotation of the swash plate 23. The piston 36 defines a compression chamber 12*b* for compressing refrigerant gas in the cylinder bore 12*a*.

An annular discharge chamber 39 is defied between the rear housing member 13 and the intercalated member 14. A suction chamber 38, which is a zone of a lower pressure than the discharge chamber 39, is defined at a position inward of the discharge chamber 39. The intercalated member 14 has suction ports 40, which communicate with the suction chambers 38, suction valves 41, which selectively open and close the suction ports 40, discharge ports 42, which communicate with the discharge chambers 39, and discharge valves 43, which selectively open and close the discharge ports 42.

When each piston 36 moves from the top dead center to the bottom dead center, refrigerant gas in the corresponding suction chamber 38 is drawn into the cylinder bore 12*a* through the corresponding suction port 40 and the corresponding suction valve 41. Refrigerant gas drawn into the cylinder bore 12*a* is compressed to a predetermined pressure as the piston 36 is moved from the bottom dead center position to the top dead center position. Then, the gas is discharged to the discharge chamber 39 through the corresponding discharge port 42 and the corresponding discharge valve 43.

The rear housing member 13 has a discharge passage 50, which communicates with the discharge chamber 39, and a suction passage 32, which communicates with the suction chamber 38. The discharge passage 50 and the suction passage 32 are connected to each other via an external refrigerant circuit 75. The external refrigerant circuit 75 includes a condenser 76, which is connected to the discharge chamber 39 via the discharge passage 50, an expansion valve 77, which is connected to the condenser 76, and an evaporator 78, which is connected to the expansion valve 77. The suction passage 32 is connected to the evaporator 78. As described above, the compressor 10 is incorporated in a refrigeration cycle.

A bleed passage 34 for connecting the suction chamber 38 with the crank chamber 15 and a supply passage 48 for connecting the discharge chamber 39 with the crank chamber 15 are formed in the cylinder block 12 and the rear housing member 13. A flow control valve 49 is located in the supply passage 48. The flow control valve 49 is an electromagnetic valve, which selectively opens and closes the supply passage 48 in accordance with supply and stop of electricity to a solenoid.

The flow control valve 49 opens or closes the supply passage 48, thereby changing the amount of high-pressure refrigerant gas supplied to the crank chamber 15 from the discharge chamber 39. The pressure in the crank chamber 15 is changed in accordance with the relationship between the supplied amount of the refrigerant gas and the amount of refrigerant gas that is conducted to the suction chamber 38 via the bleed passage 34. When the pressure in the crank chamber 15 is changed in this manner, the pressure difference between the crank chamber 15 and the cylinder bores 12*a* acts to alter the inclination angle of the swash plate 23, so that the displacement is adjusted.

Specifically, when electricity supply to the flow control valve 49 is stopped, the flow control valve 49 fully opens the supply passage 48, so that the discharge chamber 39 and the crank chamber 15 communicate with each other. Accordingly, high-pressure refrigerant gas in the discharge chamber 39 is supplied to the crank chamber 15 via the supply passage 48, so that the pressure in the crank chamber 15 is released to the suction chamber 38 via the bleed passage 34. This raises the pressure in the crank chamber 15 to minimize the inclination angle of the swash plate 23. Accordingly, the displacement of the compressor 10 is minimized.

In contrast, when electricity is supplied to the flow control valve 49, the opening degree of the supply passage 48 is made smaller than the fully open state in accordance with the supplied electricity. This reduces the amount of high-pressure refrigerant gas supplied from the discharge chamber 39 to the crank chamber 15 via the supply passage 48. Also, the pressure in the crank chamber 15 is released to the suction chamber 38 via the bleed passage 34 and is thus lowered. Such pressure reduction increases the inclination angle of the swash plate 23 from the minimum inclination angle, so that the displacement of the compressor 10 is increased from the minimum displacement.

The piston 36 will now be described.

Figure 2:
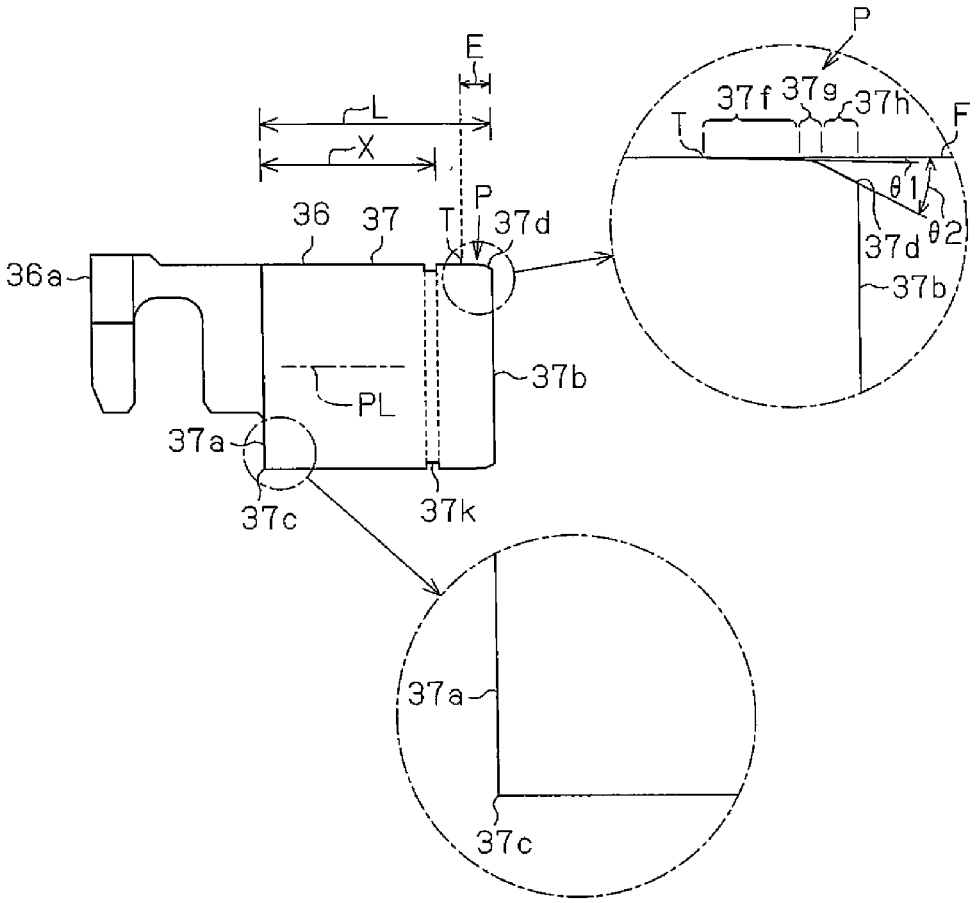
FIG. 2 is a side view illustrating a piston of the variable displacement swash plate type compressor.

As shown in FIG. 2, the piston 36 has a skirt 36*a*, which is engaged with the swash plate 23, and a columnar piston main body 37, which is formed integrally with the skirt 36*a*. The skirt 36*a* is formed at a proximal end (left end as viewed in FIG. 2) of the piston 36 with respect to the piston main body 37. A proximal surface 37*a* is formed on an end of the piston main body 37 that corresponds to the skirt 36*a* (proximal end). A distal surface 37*b* is formed on an end of the piston main body 37 that is opposite to the skirt 36*a* (distal end). The proximal surface 37*a* and the distal surface 37*b* are flat. The distance between the proximal surface 37*a* and the distal surface 37*b*, that is, the entire length of the piston main body 37, is a piston length L.

A rear peripheral portion 37*c*, which forms a right angle, is formed at the periphery of the proximal surface 37*a* of the piston main body 37. A front peripheral portion 37*d*, which has shape other than a right angle, is formed at the periphery of the distal surface 37*b* of the piston main body 37.

A chamfered portion 37*h* is formed at the distal outer circumference of the piston main body 37. The chamfered portion 37*h* forms a truncated cone the diameter of which decreases toward the distal end of the piston main body 37. An arcuate portion 37*g*, which is continuous with the chamfered portion 37*h*, is formed on the outer circumferential surface of the piston main body 37. The diameter of the arcuate portion 37*g* increases from the end closer to the distal end of the piston main body 37 (the distal surface 37*b*) toward the proximal end (the skirt 36*a*). Further, a tapering portion 37*f*, which is continuous with the arcuate portion 37*g*, is formed on the outer circumferential surface of the piston main body 37. The diameter of the tapering portion 37*f* increases from the end closer to the distal end of the piston main body 37 (the distal surface 37*b*) toward the proximal end (the skirt 36*a*). That is, the chamfered portion 37*h*, the arcuate portion 37*g*, and the tapering portion 37*f* are continuously formed on the outer circumferential surface of the piston main body 37 from the distal end toward the proximal end. The chamfered portion 37*h*, the arcuate portion 37*g*, and the tapering portion 37*f* form a crown P.

The distance between a starting point T of the tapering portion 37*f* and the distal end of the piston main body 37 (the distal surface 37*b*), that is, the length E of the crown P, is set in a range from 1.5 mm to 5.0 mm.

When the displacement of the variable displacement swash plate type compressor 10 is low, the limit value of the blow-by gas amount in a range that does not affect the control of pressure in the crank chamber 15 (the limit value of the allowable blow-by gas amount) is represented by Bx. A limit value By is a blow-by gas amount that is less than the limit value Bx, and is more preferable. During a low displacement operation, the load acting on the piston main body 37 due to compression is small, and the side force (lateral force) is also small. Thus, the side force is received only by lubricant film between the piston main body 37 and the cylinder bores 12*a*, and the piston main body 37 is scarcely tilted relative to the axis of the cylinder bore 12*a*. Therefore, during a low displacement operation, unevenness of the side clearance between the piston main body 37 and the cylinder bores 12*a* is small, so that blow-by gas scarcely leaks.

Figure 3A:
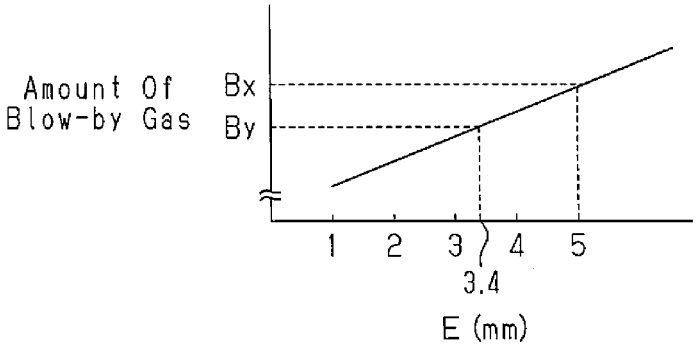
FIG. 3*a* is a graph showing the relationship between the length of a crown and the amount of blow-by gas in a low displacement state.
Figure 3B:
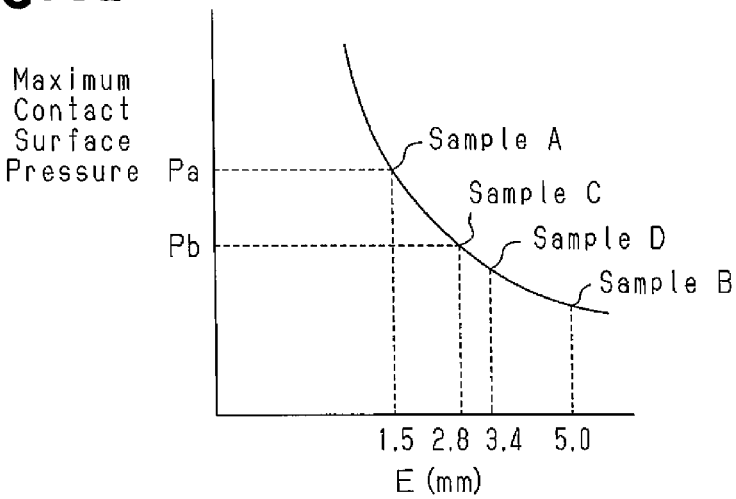
FIG. 3*b* is a graph showing the relationship between the length of the crown and the maximum contact surface pressure in the maximum displacement state.
Figure 3C:
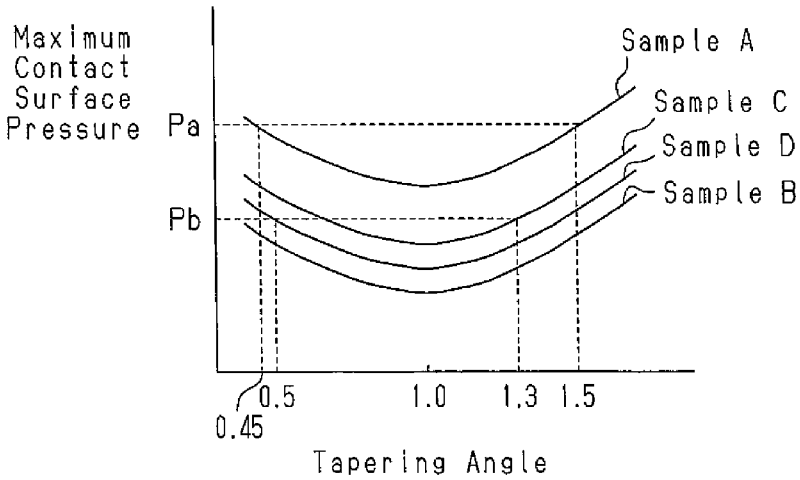
FIG. 3*c* is a graph showing the relationship between the tapering angle and the maximum contact surface pressure.

The graph of FIG. 3(*a*) shows the blow-by gas amount during a low displacement operation, in which blow-by gas is least likely to leak. The graph indicates that the longer the length E of the crown P, the greater the amount of blow-by gas becomes. Therefore, to prevent the blow-by gas amount from exceeding the limit value Bx, the length E of the crown P is preferably set less than or equal to 5.0 mm. To accurately control the displacement of the variable displacement swash plate type the compressor 10, the limit value of blow-by gas amount is preferably set to the limit value By, which is lower than the limit value Bx. Accordingly, the length E of the crown P is preferably set to be less than or equal to 3.4 mm. In this manner, the upper limit value of the length E of the crown P is determined based on the limit values Bx, By of blow-by gas amount.

Regarding the contact surface pressure of the piston main body 37 acting on the cylinder bores 12*a*, the maximum value in a range that does not affect the piston main body 37 and the cylinder bore 12*a* (the maximum value of allowable contact surface pressure) is represented by a maximum contact surface pressure Pa. A maximum contact surface pressure Pb is lower than the maximum contact surface pressure Pa.

The graph of FIG. 3(*b*) shows the relationship between the contact surface pressure and the length E of the crown P during the maximum displacement operation. During the maximum displacement operation, the piston main body 37 receives a great load due to compression, and the side force is great. Accordingly, the piston main body 37 is easily tilted relative to the axis of the cylinder bore 12*a*. The crown P functions most effectively in this situation. The surface pressure due to solid-to-solid contact between the piston main body 37 and the cylinder bores 12*a* is not generated when a lubricant film is formed between the piston main body 37 and the cylinder bores 12*a*.

If the length E of the crown P is greater than or equal to 1.5 mm, a lubricant film is formed on the tapering portion 37*f*, so that side force is received by the lubricant film. The contact surface pressure between the piston main body 37 and the cylinder bores 12*a* therefore does not exceed the maximum contact surface pressure Pa. Thus, to prevent the contact surface pressure from exceeding the maximum contact surface pressure Pa, the length E of the crown P is preferably set greater than or equal to 1.5 mm. Hence, to reduce the blow-by gas amount and prevent the contact surface pressure from exceeding the maximum contact surface pressure Pa, the length E of the crown P is preferably set in a range from 1.5 mm to 5.0 mm.

Likewise, when the limit value of the blow-by gas amount is set to By, the upper limit value of the length E of the crown P is set to be less than or equal to 3.4 mm. In FIG. 3(*b*), when the maximum contact surface pressure is Pb, the lower limit value of the length E of the crown P is set to 2.8 mm. Accordingly, the length E of the crown P is more preferably set in a range from 2.8 mm to 3.4 mm.

A piston 36 in which a maximum contact surface pressure Pa is obtained when the length E of the crown P is 1.5 mm is denoted by sample A, and a piston 36 in which a more preferable maximum contact surface pressure Pb is obtained when the length E of the crown P is 2.8 mm is denoted by sample C. Further, a piston 36 in which a maximum contact surface pressure smaller than the maximum contact surface pressure Pb is obtained when the length E of the crown P is 3.4 mm is denoted by sample D, and a piston 36 in which a maximum contact surface pressure less than the maximum contact surface pressure of sample D is obtained when the length E of the crown P is 5.0 mm is denoted by sample B. In the piston main body 37, a line that extends parallel with the central axis PL and is located on the circumferential surface of the piston main body 37 is defined as a tangent F. The angle between the tangent F and the tapering portion 37*f*, or a tapering angle, is denoted by θ1.

In the case of sample A, the contact surface pressure between the piston main body 37 and the cylinder bore 12*a* does not exceed the maximum contact surface pressure Pa when the tapering angle θ1 is in the range from 0.45 degrees to 1.5 degrees, as shown in FIG. 3(*c*). Also, in the case of sample B, the contact surface pressure between the piston main body 37 and the cylinder bore 12*a* does not exceed the maximum contact surface pressure Pa when the tapering angle θ1 is in the range from 0.45 degrees to 1.5 degrees. If the tapering angle θ1 is less than 0.45 degrees, minute projections and recesses on the piston main body 37 and the cylinder bore 12*a* form a restriction between the cylinder bore 12*a* and a part closer to the distal surface 37*b* than the starting point T. Accordingly, lubricant does not reach a part closer to the proximal surface 37*a* than the restriction, so that no lubricant film is formed there. This reduces the length of the lubricant film formed on the tapering portion 37*f* along the central axis PL, and the pressure of the lubricant film is not raised. That is, solid-to-solid contact occurs between the piston main body 37 and the cylinder bore 12*a*, which increases the contact surface pressure.

On the other hand, if the tapering angle θ1 is greater than 1.5 degrees, although lubricant is allowed to enter the tapering portion 37*f*, the clearance of the piston main body 37 in the circumferential direction is widened. Thus, lubricant flows in the circumferential direction, and lubricant film is hard to form. As a result, solid-to-solid contact occurs between the piston main body 37 and the cylinder bore 12*a*, which increases the contact surface pressure.

Therefore, when the length E of the crown P is set as described above, the angle of the tapering portion 37*f* is preferably set in a range from 0.45 degrees to 1.5 degrees.

Further, when the length E of the crown P is set as described above, the angle of the tapering portion 37*f* is more preferably set in a range from 0.5 degrees to 1.3 degrees.

The arcuate portion 37*g* is formed to be gently arcuate, and the chamfered portion 37*h* has a shape that changes more gently than the arcuate portion 37*g*. In the piston main body 37, a line that extends parallel with the central axis PL and is located on the circumferential surface of the piston main body 37 is defined as a tangent F. The angle between the tangent F and the chamfered portion 37*h*, or an inclination angle, is denoted by θ2. The inclination angle θ2 is preferably set approximately to 30 degrees. Therefore, the piston main body 37 has a barrel-like shape with its diameter gradually decreasing toward the distal surface 37*b*.

As shown in FIG. 2, an introduction groove 37*k* is formed on the outer circumferential surface of the piston main body 37, at a position closer to the proximal surface 37*a* than the tapering portion 37*f*. The introduction groove 37*k* extends along the entire circumference of the piston main body 37. The position of the introduction groove 37*k* is preferably determined such that the distance X between the proximal surface 37*a* and introduction groove 37*k* and the piston length L satisfies the expression $0.6<X/L<0.8$.

The introduction groove 37*k* is provided to supply lubricant between the piston main body 37 and the cylinder bore 12*a* to the entire circumference of the piston main body 37 and to urge the piston main body 37 away from the cylinder bores 12*a*. If the depth of the introduction groove 37*k* is less than 0.1 mm, the amount of lubricant retained in the introduction groove 37*k* is reduced so that it will be difficult for the introduction groove 37*k* to spread lubricant to the entire circumference of the piston main body 37. Thus, the depth of the introduction groove 37*k* is preferably greater than or equal to 0.1 mm. Setting the depth of the introduction groove 37*k* to a value greater than or equal to 0.1 mm allows the introduction groove 37*k* to spread lubricant over the entire circumference of the piston main body 37, so that unevenness of lubricant film is prevented. As a result, the lubricant film limits tilting of the piston main body 37 to eliminates the unevenness of the side clearance. This reduces the increase in the flowing amount of the blow-by gas due to the side clearance.

If the opening width of the introduction groove 37*k* along the axis of the piston main body 37 is less than 0.5 mm, the amount of lubricant in the introduction groove 37*k* is reduced and the above described urging effect is lowered. In contrast, if the opening width of the introduction groove 37*k* is greater than or equal to 1.5 mm, the sealing performance of the lubricant film formed by the lubricant in the introduction groove 37*k* is lowered. Therefore, the opening width of the introduction groove 37*k* along the axis of the piston main body 37 is preferably set greater than or equal to 0.5 mm and less than 1.5 mm.

Operation of the compressor 10 will now be described.

When the drive shaft 16 rotates as the engine 20 operates, each piston 36 moves from the top dead center position to the bottom dead center position. Accordingly, refrigerant gas in the suction chamber 38 is drawn into the cylinder bore 12*a* via the suction port 40 and the suction valve 41. At this time, the rear peripheral portion 37*c* of the piston main body 37 slides along the cylinder bore 12*a*. Since the rear peripheral portion 37*c* forms a right angle, a small clearance is maintained between the cylinder bores 12*a* and the piston main body 37. This reduces the likelihood of lubricant leaking to the crank chamber in a great amount.

Figure 4:
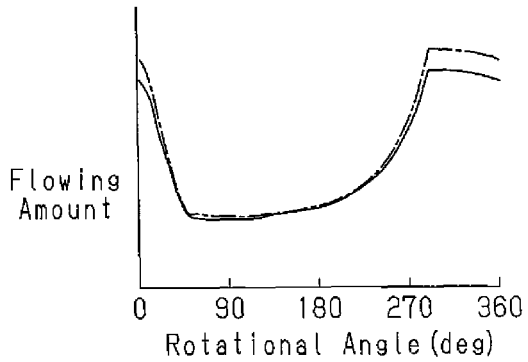
FIG. 4 is a graph showing the relationship between the flowing amount of lubricant between the piston main body and the cylinder bore and the rotational angle of the drive shaft.

In the graph of FIG. 4, the solid line indicates the flowing amount of lubricant in a case in which the pistons 36 of the present embodiment are employed. The line formed by a long dash alternating with one short dash indicates the flowing amount of lubricant in a case in which the rear peripheral portion 37*c* of the piston main body 37 and the front peripheral portion 37*d* of the compression chamber are both chamfered (a piston of Comparison Example 1). As shown in FIG. 4, compared to the case of the piston of Comparison Example 1, the flowing amount of lubricant between the cylinder bore 12*a* and the piston main body 37 is small at any rotational angle in the case of the piston 36 of the present embodiment. This indicates that, at the rear peripheral portion 37*c* of the piston main body 37, likelihood of lubricant leaking in a great amount is reduced. As a result, it is possible to retain lubricant between the piston main body 37 and the cylinder bores 12*a*.

Refrigerant gas drawn into the cylinder bore 12*a* is compressed to a predetermined pressure as the piston 36 is moved from the bottom dead center position to the top dead center position. Then, the gas is discharged to the discharge chamber 39 via the corresponding discharge port 42 and the corresponding discharge valve 43. During the period from suction to discharge of refrigerant gas, the piston main body 37 receives side force, which acts to tilt the piston main body 37. However, since the length E and the tapering angle θ1 of the crown P are set to appropriate values, a lubricant film is formed between the piston main body 37 and the cylinder bores 12*a*. The lubricant film receives the side force to limit the tilting of the piston main body 37.

During the compression stroke, high-pressure refrigerant gas, which has been compressed at the top dead center position, flows as blow-by gas toward the crank chamber 15 through between the piston 36 and the cylinder bores 12*a* (through the side clearance).

As described above, the piston main body 37 has the tapering portion 37*f* and the arcuate portion 37*g*, and the length E and the tapering angle θ1 of the crown P are set to appropriate values. The piston 36 is tilted in relation to the central axis PL when receiving compression reaction force. However, during the compression stroke, lubricant is drawn into between the cylinder bore 12*a* and the piston main body 37 by the wedge effect. As a result, a lubricant film is formed between the cylinder bores 12*a* and the piston main body 37, and the pressure of the lubricant film is increased by the wedge effect. Although a small amount of lubricant is allowed to leak due to the surface roughness of the piston main body 37 and the cylinder bores 12*a*, the repulsive force of the lubricant film urges the piston main body 37 away from the cylinder bore 12*a*. Thus, the contact surface pressure due to solid-to-solid contact between the cylinder bore 12*a* and the piston main body 37 is lowered, and wear of the cylinder bore 12*a* is reduced.

Since the crown P of the piston main body 37 has the chamfered portion 37*h*, the arcuate portion 37*g*, and the tapering portion 37*f* arranged from the distal end toward the proximal end, the shape of the crown P is gradually changed. Thus, the side clearance between the distal end of the piston main body 37 and the cylinder bore 12*a* gradually decreases toward the proximal end, so that lubricant is reliably drawn into the side clearance when the piston 36 reciprocates. Therefore, lubricant film is formed and maintained between the piston main body 37 and the cylinder bores 12*a*.

Since the introduction groove 37*k* is provided to supply lubricant between the piston main body 37 and the cylinder bore 12*a* to the entire circumference of the piston main body 37, unevenness of the lubricant film in the circumference direction is reduced. This allows the lubricant film to reliably exert urging force. As a result, tilting of the piston main body 37 caused by the thickness of the lubricant film (the pressure of the lubricant film) is reduced, which reduces the likelihood of the piston main body 37 unevenly contacting the cylinder bores 12*a*. In consequence, the unevenness of the side clearance along the entire circumference of the piston main body 37 is limited. This reduces an increase in the flowing amount of blow-by gas due to the side clearance.

Figure 5A:
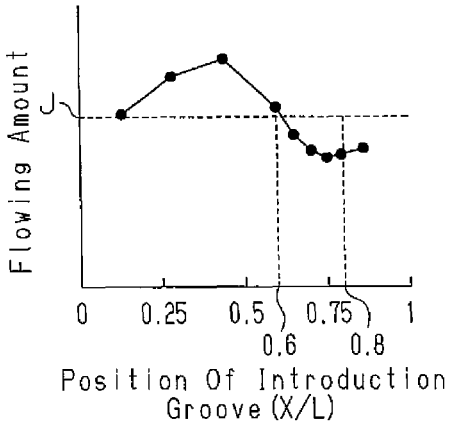
FIG. 5*a* is a graph showing the relationship between the position of an introduction groove and the flowing amount of blow-by gas.
Figure 5B:
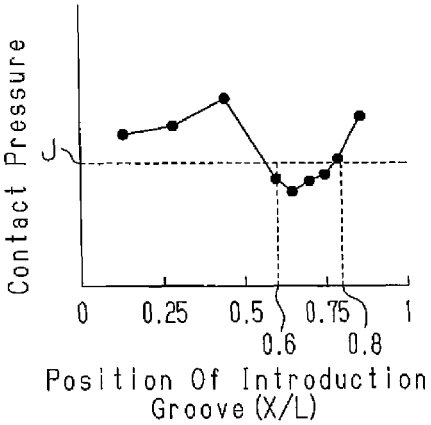
FIG. 5*b* is a graph showing the relationship between the position of the introduction groove and the contact pressure applied to the cylinder bore.
Figure 6:
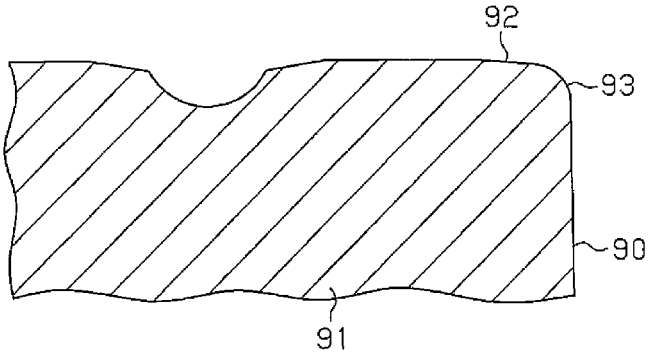
FIG. 6 is a partial cross-sectional view showing a piston of a background art.

The position of the introduction groove 37*k* is determined such that the distance X and the piston length L satisfy the expression $0.6<X/L<0.8$. By determining the position of the introduction groove 37*k* in this manner, the flowing amount of the blow-by gas is lower than that in a case in which no introduction groove 37*k* is formed as shown in FIG. 5(*a*) (reference line J). Further, as shown in FIG. 5(*b*), by determining the position of the introduction groove 37*k* in this manner, the contact surface pressure between the piston main body 37 and the cylinder bore 12*a* is also lower than that in a case in which no introduction groove 37*k* is formed (reference line J).

The above described embodiment has the following advantages.

(1) Based on analysis of the amount of blow-by gas and the maximum contact surface pressure, the tapering angle θ1 of the tapering portion 37*f* in the piston main body 37 is set in a range from 0.45 degrees to 1.5 degrees, and the length E of the crown P is set in a range from 1.5 mm to 5.0 mm. This reduces wear of the cylinder bores 12*a* and the amount of blow-by gas.

(2) The tapering portion 37*f* is formed in the crown P of the piston main body 37 to have a tapering angle θ1 in a range from 0.45 degrees to 1.5 degrees. This allows a lubricant film to be reliably formed between the cylinder bores 12*a* and the piston main body 37, thereby reducing solid-to-solid contact between the piston main body 37 and the cylinder bores 12*a*. Therefore, the contact surface pressure is prevented from reaching the maximum contact surface pressure Pa, and wear of the cylinder bore 12*a* is reduced.

(3) The length E of the crown P is set in a range from 1.5 mm to 5.0 mm. When the piston main body 37 is not significantly affected by side force, for example, during a low displacement operation, setting the length E of the crown P to be less than or equal to 5.0 mm ensures a length along the central axis PL of lubricant film formed between the cylinder bore 12*a* and the piston main body 37. This limits tilting of the piston main body 37 caused by side force and the amount of blow-by gas that flows through between the cylinder bores 12*a* and the piston main body 37. On the other hand, when the piston main body 37 is greatly affected by side force, for example, during a large displacement operation, setting the length E of the crown P to be greater than or equal to the lower limit value of 1.5 mm reliably forms lubricant film, which receives the side force. As a result, the contact surface pressure is prevented from reaching the maximum contact surface pressure Pa while reducing the amount of blow-by gas, and wear of the cylinder bore 12*a* is reduced.

(4) The tapering portion 37*f* formed in the piston main body 37 exerts the wedge effect. Due to the wedge effect, lubricant is drawn into between the cylinder bore 12*a* and the piston main body 37, and the pressure of the lubricant film is increased. The repulsive force of the lubricant film urges the piston main body 37 away from the cylinder bore 12*a*. Thus, the contact surface pressure due to solid-to-solid contact between the cylinder bore 12*a* and the piston main body 37 is lowered, and wear of the cylinder bore 12*a* is reduced.

(5) The position of the introduction groove 37*k* is set such that the distance X and the piston length L satisfy the expression $0.6<X/L<0.8$. If the introduction groove 37*k* is excessively close to the distal end of the piston main body 37, lubricant cannot be readily supplied to the entire piston main body 37. The configuration prevents such a drawback. That is, by arranging the introduction groove 37*k* at an appropriate position, lubricant film can be formed substantially over the entire space between the piston main body 37 and the cylinder block 12, so that the contact pressure between the cylinder bore 12*a* and the piston main body 37 is reduced.

(6) Further, by setting the position of the introduction groove 37*k* in a manner described above, the introduction groove 37*k* is prevented from being excessively close to the proximal end of the piston main body 37. In other words, the introduction groove 37*k* is prevented from being excessively far from the compression chamber 12*b*. Therefore, flow of blow-by gas is restricted at the distal surface 37*b* of the piston main body 37, so that the amount of blow-by gas flowing to the crank chamber 15 is effectively reduced.

(7) The rear peripheral portion 37*c* of the piston main body 37 forms a right angle. Thus, the side clearance between the rear peripheral portion 37*c* of the piston main body 37 and the cylinder bores 12*a* is maintained at a constant value without being widened. This reduces the likelihood of lubricant leaking in a great amount at the rear peripheral portion 37*c* of the piston main body 37. As a result, lubricant is retained between the piston main body 37 and the cylinder bores 12*a* to ensure the thickness of lubricant film, which reduces the likelihood of solid-to-solid contact between the piston main body 37 and the cylinder bores 12*a*.

(8) The crown P is not simply formed on the piston main body 37. Instead, the parameters such as the position and angle of the tapering portion 37*f* and the position of the introduction groove 37*k* are considered and determined comprehensively to reduce wear of the cylinder bore 12*a* and the amount of blow-by gas flowing to the crank chamber 15.

(9) The piston 36 has at the distal end of the piston main body 37 the chamfered portion 37*h*, the arcuate portion 37*g*, which is continuous with the chamfered portion 37*h*, and the tapering portion 37*f*, which is continuous with the arcuate portion 37*g*. Thus, the shape of the piston main body 37 gradually changes from the distal end toward the proximal end. Therefore, the side clearance between the distal end of the piston main body 37 and the cylinder bore 12*a* gradually decreases toward the proximal end, so that lubricant is reliably drawn into the side clearance when the piston 36 reciprocates. As a result, the lubricant film between the piston main body 37 and the cylinder bores 12*a* is maintained, and the amount of the blow-by gas leaking to the crank chamber 15 is reduced by the sealing performance of the lubricant film.

(10) The tapering angle of the tapering portion 37*f* is set to be small in a range from 0.45 degrees to 1.5 degrees, and the arcuate portion 37*g* and the chamfered portion 37*h* form a predetermined space between the cylinder bores 12*a* and the piston main body 37. This allows adequate amount of lubricant to be reliably supplied to the tapering portion 37*f*. Also, when the piston 36 is installed in the cylinder bore 12*a*, the chamfered portion 37*h* prevents a corner of the tapering portion 37*f* from forming a dent in the cylinder bores 12*a* by scratching. If blow-by gas passes through such a dent in the cylinder bores 12*a*, the amount of blow-by gas will be increased. The above described embodiment prevents such a possible drawback, thereby allowing the amount of blow-by gas to be reliably controlled.

(11) The tapering angle θ1 of the tapering portion 37*f* is more preferably set in a range from 0.5 degrees to 1.3 degrees, and the length E of the crown P is more preferably set in a range from 2.8 mm to 3.4 mm. These settings reduce the amount of blow-by gas to a level lower than the maximum value that is allowable during a low displacement operation, and reduce the maximum contact surface pressure to a level lower than the maximum value in a range that does not affect the piston main body 37 and the cylinder bore 12*a*.

The above described embodiment may be modified as follows.

In the above described embodiment, the crown P is formed by the chamfered portion 37*h*, the arcuate portion 37*g*, and the tapering portion 37*f*. However, the chamfered portion 37*h* may be omitted, for example, so that the crown P is formed only by the arcuate portion 37*g* and the tapering portion 37*f*.

In the above described embodiment, the chamfered portion 37*h* forms a truncated cone the diameter of which decreases toward the distal end of the piston main body 37. However, the chamfered portion 37*h* may be formed such that the radius of curvature is gradually increased toward the distal end of the piston main body 37.

In the above described embodiment, the rear peripheral portion 37*c* of the piston main body 37 forms a right angle. However, the rear peripheral portion 37*c* may be arcuate or tapered.

In the above described embodiment, the compressor 10 receives rotational drive force from the vehicle engine 20 via the clutchless power transmission. However, the compressor 10 may receive rotational drive force from the vehicle engine via a clutch-type power transmission mechanism.

Therefore, the present examples and embodiments are to be considered as illustrative and not restrictive and the invention is not to be limited to the details given herein, but may be modified within the scope and equivalence of the appended claims.

The invention claimed is:

1. A variable displacement swash plate type compressor comprising:

a cylinder block, in which a plurality of cylinder bores are formed;

a plurality of single-headed pistons, each of which is accommodated in one of the cylinder bores and has a main body and a skirt, the skirt being formed at a position closer to a proximal end of the piston than the main body;

a drive shaft;

a swash plate, which rotates integrally with the drive shaft and is engaged with the skirts;

a crank chamber, which accommodates the swash plate; and a plurality of compression chambers, each of which is defined in one of the cylinder bores by the associated piston main body, wherein displacement of the compressor is controllable by controlling the inclination angle of the swash plate by changing the pressure in the crank chamber; wherein a tangent is defined that extends parallel with a central axis of each piston main body and is located on an outer circumferential surface of the piston main body; wherein each piston main body has a distal portion located on a distal end opposite the skirt, an angled tapering portion and an arcuate portion are formed in the distal portion, the arcuate portion is continuous with an end of the tapering portion with the tapering portion situated between the arcuate portion and the skirt, the tapering portion and the arcuate portion each have a diameter that increases toward the skirt, the tapering portion has a tapering angle that is in a range from 0.45 degrees to 1.5 degrees with respect to the tangent, and the distance between the distal end of the piston main body and a starting point of the tapering portion on an end closer to the skirt is set in a range from 1.5 mm to 5.0mm; wherein each piston main body also has a chamfered portion, which is continuous with the arcuate portion, the chamfered portion located at a position in the piston main body that is further from the skirt than the arcuate portion.

2. The variable displacement swash plate type compressor according to claim 1, wherein an angle between the tangent and the surface of the chamfered portion is set at 30 degrees.

3. The variable displacement swash plate type compressor according to claim 1, wherein an introduction groove is formed in the outer circumferential surface of each piston main body and at a position closer to the skirt than the tapering portion, and the introduction groove extends along the entire circumferential surface in the circumferential direction.

4. The variable displacement swash plate type compressor according to claim 3, wherein a distance X between an end face of the skirt and the introduction groove in each piston main body and an entire length L of the piston main body satisfy an expression $0.6<X/L<0.8$.

5. The variable displacement swash plate type compressor according to claim 3, wherein each introduction groove has a depth that is greater than or equal to 0.1 mm, and an opening width that is greater than or equal to 0.5 mm.

6. The variable displacement swash plate type compressor according to claim 1, wherein the tapering angle set in a range from 0.5 degrees to 1.3 degrees.

7. The variable displacement swash plate type compressor according to claim 1, wherein the distance is set in a range from 2.8 mm to 3.4 mm.

8. The variable displacement swash plate type compressor according to claim 1, wherein a peripheral portion of each piston main body at an end corresponding to the skirt forms a right angle.

* * * * *